US005223050A

United States Patent [19]

Bryant et al.

[11] Patent Number: 5,223,050

[45] Date of Patent: Jun. 29, 1993

[54] AL-MG-SI EXTRUSION ALLOY

[75] Inventors: Anthony J. Bryant, Banbury; David J. Field, Tean; Ernest P. Butler, Banbury, all of England

[73] Assignee: Alcan International Limited, Montreal, Canada

[21] Appl. No.: 903,815

[22] Filed: Jun. 23, 1992

Related U.S. Application Data

[63] Continuation of Ser. No. 580,344, Sep. 6, 1990, abandoned, which is a continuation of Ser. No. 303,723, Jan. 27, 1989, abandoned, which is a continuation of Ser. No. 910,896, Sep. 24, 1986, abandoned.

[30] Foreign Application Priority Data

Sep. 30, 1985 [GB] United Kingdom ..... 8524077

[51] Int. Cl.[5] ..... C22C 21/04; C22C 21/08

[52] U.S. Cl. ..... 148/415; 148/417; 148/439; 148/440; 420/534; 420/546

[58] Field of Search ..... 420/534, 535, 544, 546, 420/548; 148/415, 417, 439, 440

[56] References Cited

U.S. PATENT DOCUMENTS

| | | | |
|---|---|---|---|
| 3,113,052 | 12/1963 | Schneck | 148/690 |
| 3,222,227 | 12/1965 | Baugh et al. | 148/415 |
| 3,326,270 | 6/1964 | Collins et al. | 164/89 |
| 3,816,190 | 6/1974 | Warbichler et al. | 148/690 |
| 4,412,870 | 11/1983 | Vernam et al. | 148/440 |
| 4,659,396 | 4/1987 | Lifks et al. | 148/415 |
| 4,808,247 | 2/1989 | Komatsubara et al. | 148/415 |

FOREIGN PATENT DOCUMENTS 143039 8/1984 Japan ..... 420/546

OTHER PUBLICATIONS

Shibata, K. et al, "Effect of Precipitation Heat Treatment on Extrudability of Ingots of 6063 Alloy," Sumitomo Light Metal Technical Report, v. 26, pp. 327-335, 1976.

Chemical Abstracts vol. 75, No. 10, Sep. 6, 1971, p. 303, abstract No. 68335s.

Scharf (I), G., et al., "Das Auftreten von Magnesiumsilizidausscheidungen in Strangpressprofilen aus AlMgSiO.5 auf Basis Al 99.9", Metall. 20 (1966) v. 3, pp. 203-209 (and translation).

Scharf (II), G., et al., "Verbesserte Giesstechnik für Rundbarren aus AlMgSiO.5 und Einfluss des Gussgefüges auf die Pressbarkeit", Metall. 32 (1978), v. 6, pp. 555-560 (and translation).

Westengen, H., et al., "Precipitation Reactions in an Aluminium 1 wt. % $Mg_2Si$ Alloy", Z. Metallkunde., 70 (1979), v. 8, 99. 528-535.

*Primary Examiner*—George Wyszomierski

*Attorney, Agent, or Firm*—Cooper & Dunham

[57] ABSTRACT

An extrusion ingot of an Al-Mg-Si alloy, has substantially all the Mg present in the form of particles having an average diameter of at least 0.1 microns of beta'-phase $Mg_2Si$ in the substantial absence of bet-phase $Mg_2Si$. The ingot may be made by casting an ingot of the alloy, homogenizing the ingot, cooling the homogenized ingot to a holding temperature of 250° C. to 425° C. at a cooling rate of at least 400° C./h, holding the ingot for 0.25 to 3 hours, and cooling. The ingot has improved extrusion properties.

8 Claims, 6 Drawing Sheets

AL-MG-SI EXTRUSION ALLOY

This is a continuation of application Ser. No. 580,344, filed Sep. 6, 1990, which is a continuation of application Ser. No. 303, 723, filled Jan. 27, 1989, which is a continuation of application Ser. No. 910,896, filed Sep. 24, 1986, all abandoned.

This invention concerns the extrusion of aluminium alloys of the precipitation hardenable type, and in which the principal hardening ingredients are magnesium and silicon. The invention is concerned with control the microstructure of the alloy from casting to extrusion, to maximise its ability to be extruded consistently at high speed with defect-free surface finish and with acceptable mechanical properties.

In an aluminium extrusion plant, the aluminium is fed to extrusion equipment in the form of cast ingots in a convenient size, which are first heated to a proper temperature high enough for extrusion, and are then forced through an extrusion die to form an extrudate of predetermined cross section. The ingots are formed by casting an aluminium alloy of predetermined composition, and are subsequently homogenised by soaking at an elevated temperature to control the state of the soluble secondary phase particles (magnesium silicide, $Mg_2Si$). This invention achieves control of the alloy microstructure by controlling the composition of the alloy, and by control of the conditions of casting and more particularly of homogenisation.

The requirements of an extrusion ingot in the context of this invention are:

a) It should have a chemical composition including a sufficient level of the major alloy elements, magnesium and silicon, to satisfy the mechanical property requirements of the extrudate.

b) The matrix structure should be controlled to minimise the yield stress at elevated temperature, for the given chemical composition, so as to maximise ease of extrusion.

c) The microstructure should have maximum uniformity with respect to both matrix structure and size, shape and distribution of secondary phase particles.

d) The soluble secondary phase particles (magnesium silicide) should be in a sufficiently fine and uniform distribution to remain undissolved up until extrusion deformation takes place and then to dissolve fully in the deformation zone so that maximum mechanical properties can be achieved by subsequent age-hardening.

e) The insoluble secondary phase particles should preferably be fine and uniformly distributed such that they do not give rise to non-uniformity in the extrudate, either before or after anodising.

U.S. Pat. No. 3,222,227 describes a method of pretreating an extrusion ingot of an aluminium alloy of the 6063 type. The ingot is homogenised and then cooled fast enough to assure retention in solution of a large portion of the magnesium and silicon, preferably most of it, and to assure that any precipitate that is formed is mainly present in the form of small or very fine readily redissolvable $Mg_2Si$. Extrudates formed from such ingots have, after aging, improved strength and hardness properties.

U.S. Pat. No. 3,113,052 describes another step-cooling treatment aimed at achieving uniform mechanical properties along the length of the extrudate without a recrystallised outer band.

U.S. Pat. No. 3,816,190 describes yet another step-cooling treatment, aimed at improving processability of the ingot in an extruder. Initial cooling rates of at least 100° C./hr are envisaged, without any detail being given, down to a hold temperature of 230°-270° C.

According to one aspect of the present invention, there is provided an extrusion ingot of an Al-Mg-Si alloy wherein substantially all the Mg is present in the form of particles having an average diameter of at least 0.1 microns of bet'-phase $Mg_2Si$ in the substantial absence of beta-phase $Mg_2Si$.

In another aspect of the invention, there is provided a method of forming such an extrusion ingot by:

Casting an ingot of the Al-Mg-Si alloy,

Homogenising the ingot,

Cooling the homogenised ingot to a temperature of 250° C. to 425° C. at a cooling rate of at least 200° C./h.

Holding the ingot at a holding temperature of from 250° C. to 425° C. for a time to precipitate substantially all the Mg as beta'-phase $Mg_2Si$ in the substantial absence of beta-phase $Mg_2Si$, Cooling the ingot.

The invention also contemplates a method of forming an extrudate by reheating the ingot and hot extruding it through a die.

The alloy may be of the 6000 series (of the Aluminium Association Inc. Register) including 6082, 6351, 6061, and particularly 6063 types. The alloy composition may be as follows (in % by weight).

| | 6000 | 6082 | | |
|---|---|---|---|---|
| | Series | Preferred | Optimium | 6061 |
| Mg | 0.39-1.50 | 0.50-0.70 | 0.57-0.63 | 0.70-1.10 |
| Si | 0.35-1.30 | 0.85-0.95 | 0.87-0.93 | 0.60-0.70 |
| Mn | 0-0.50 | 0.40-0.50 | 0.45-0.50 | 0-0.15 |
| Fe | 0-0.30 | 0.18-0.30 | 0.18-0.22 | 0.18-0.25 |
| Ti | 0-0.05 | 0.01-0.03 | 0.01-0.03 | 0.01-0.03 |
| Cu | 0-0.40 | | | 0.25-0.40 |
| Cr | 0-0.20 | | | 0.12-0.20 |

balance Al, apart from incidential impurities and minor alloying elements such as Mo, V, W and Zr, each maximum 0.05% total 0.15%.

For a 6063-type alloy, the composition is as follows (in % by weight):

| Element | Broad | Preferred | Optimum |
|---|---|---|---|
| Mg | 0.39-1.5 | 0.39-0.55 | 0.42-0.46 |
| Si | 0.35-1.3 | 0.35-0.46 | 0.42-0.46 |
| Fe | 0-0.24 | 0.16-0.24 | 0.16-0.20 |
| Mn | 0-0.10 | 0.02-0.10 | 0.03-0.07 |
| Ti | 0-0.05 | 0.01-0.04 | 0.015-0.025 |

balance Al, apart from incidental impurities up to a maximum of 0.05% each and 0.15% in total.

In order to comply with European 6063-F22 mechanical property specifications, it is necessary that the extrudate be capable of attaining an ultimate tensile strength (UTS) value of at least about 230MPa, for example from 230 to 240 Mpa. We have determined experimentally that this target can be attained with magnesium and silicon contents in the range 0.39 to 0.46% , preferably 0.42 to 0.46%, so as to provide an $Mg_2Si$ content from 0.61 to 0.73% preferably 0.66 to 0.73%, provided that all the available solute is utilised in age-hardening. The use of alloys having higher contents of silicon and magnesium, such as conventional 6063 alloys, or 6082, 6351 or 6061 alloys, increases the hardness, and reduces the solidus with the result that an extrusion ingot of the alloys can be extruded only at lower speeds, although other advantages are still obtained, as described below.

The iron content of 6063 alloys is specified as 0 to 0.24%, preferably 0.16 to 0.24% optimally 0.16 to 0.20%. Iron forms insoluble Al-Fe-Si particles which are not desired. Alloys containing less than about 0.16% Fe are more expensive and may show less good colour uniformity after anodising.

The manganese content of 6063 alloys is specified as from 0 to 0.10%, preferably 0.02 to 0.10, particularly 0.03 to 0.07%. Manganese assists in ensuring that any iron is present in the as-cast ingot in the form of fine beta-Al-Fe-Si platelets preferably not more than 15 microns in length or, if in the alpha form, substantially free from script and eutectics.

Titanium is present at a level of 0 to 0.05%, preferably 0.01 to 0.04% particularly 0.015 to 0.025%, in the form of titanium diboride as a grain refiner.

The extrusion ingots may be cast by a direct chill (DC) casting process, preferably by means of a short-mold or "hot-top" DC process such as is described in U.S. Pat. No. 3,326,270. Under suitable casting conditions there is obtained an ingot having a uniform grain size and 70 to 90 microns and a cell size of 28 to 35 microns, preferably 28 to 32 microns, over the whole ingot cross-section; with the insoluble secondary phase in the form of fine beta-Al-Fe-Si platelets preferably not more than 15 microns in length or, if in the alpha form, free from script and coarse eutectic particles.

The purposes of homogenising the extrusion ingot is to bring the soluble secondary magnesium-silicon phases into suitable form. By way of background, it should be understood that magnesium-silicon particles can be precipitated out of solution in aluminium in three forms depending on the conditions (K. Shibata, I. Otsuka, S. Anada, M. Yanabi, and K. Kusabiraki, Sumitomo Light Metal Technical Reports Vol. 26 (7), 327-335 (1976).

a) On holding at 400° C. to 480° C. (depending on alloy composition), $Mg_2Si$ precipitates as beta-phase blocks on a cubic lattice, which are initially of sub micron size but grow rapidly.

b) On holding at 250° C. to 425° C., particularly around 300° C. to 350° C. (depending on alloy composition), $Mg_2Si$ precipitates as beta'-phase platelets typically 3 to 4 microns long by 0.5 microns wide, of hexagonal crystal structure. These platelets are semi-coherent with the alloy matrix with the strains being accommodated by dislocations of the aluminium crystal structure. The dissolution and growth of the beta'-phase precipitate at 350° C. in sheet samples has been reported (Chemical Abstracts, vol 75, No. 10, 6 Sep. 1971, page 303, abstract 68335 s).

c) On being held at around 180°, $Mg_2Si$ precipitates as beta''-phase needles, less than 0.1 microns in length, of hexagonal structure and which are coherent with the crystal structure of the matrix. This fine precipitate is what is formed on age-hardening. The larger precipitates (a) and (b) do not contribute to the hardness of the product.

Precipitates (b) and (c) are metastable with respect to (a), but are in practice stable indefinitely at ambient temperatures.

The method of the invention involves heating the extrusion ingot for a time and at a temperature to ensure substantially complete solubilisation of the magnesium and silicon. Then the ingot is rapidly cooled to a temperature in the range 250° C. to 425° C., preferably in the range of 280° C. to 400° C. and optimally in the range of 300° C. to 350° C. The permitted and optimum holding temperature ranges may vary depending on the alloy composition. The rate of cooling should be sufficiently rapid that no significant precipitation of beta-phase $Mg_2Si$ occurs. We specify a minimum cooling rate of 400° C./h, but prefer to cool at a rate of at least 500° C./h. The ingot is then held at a holding temperature within above range for a time to precipitate substantially all the magnesium as beta'-phase $Mg_2Si$. This time may typically be in the range of 0.25 or 0.5 to 3h, with longer times generally required at lower holding temperatures. Subsequently, the ingot is cooled, generally to ambient temperature and preferably a rate of at least 100° C./h to avoid the risk of any undesired side effects.

When we say that substantially all the Mg is precipitated as beta'-phase $Mg_2Si$, we envisage that substantially all the supersaturated Mg in the cooled ingot be present in the form of beta'phase $Mg_2Si$, with substantially none, and preferably none at all, present as beta-phase $Mg_2Si$. The Si is present in a stoichiometric excess over Mg, and approximately one-quarter by weight of the excess is available to form Al-Fe-Si, which should be in the form of alpha-Al-Fe-Si particles, preferably below 15 microns long and with 90% below 6 microns long. The remainder of the excess silicon contributes to the age-hardenability of the matrix.

BRIEF DESCRIPTION OF THE DRAWINGS

Reference is directed to the accompanying drawings, in which.

Figure 1A:
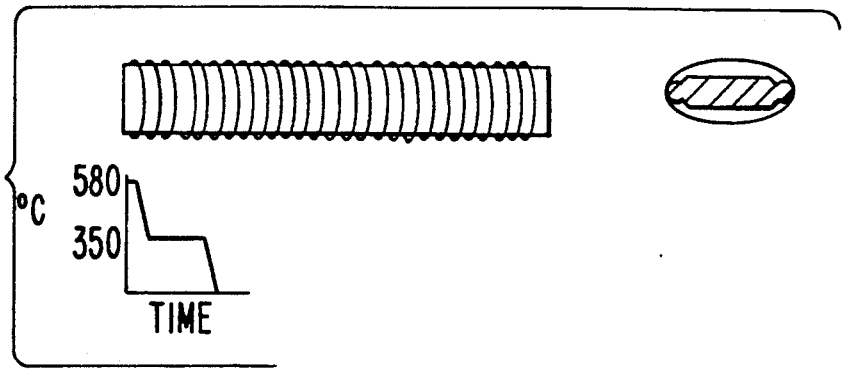
FIG. 1 is a four-part diagram showing the state of the $Mg_2Si$ precipitate during and after interrupted cooling following homogenisation.
Figure 1B:
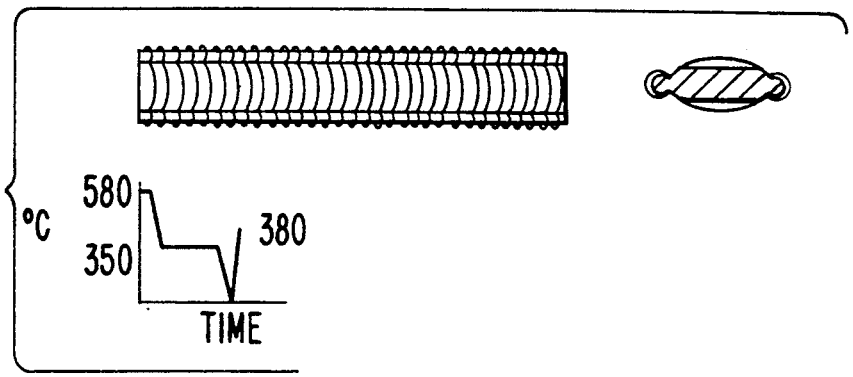
Figure 1C:
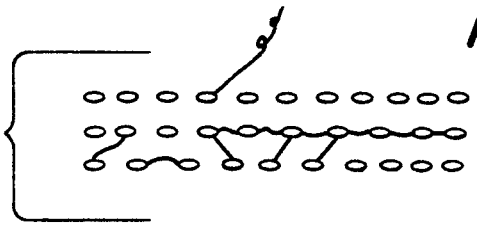
Figure 1D:
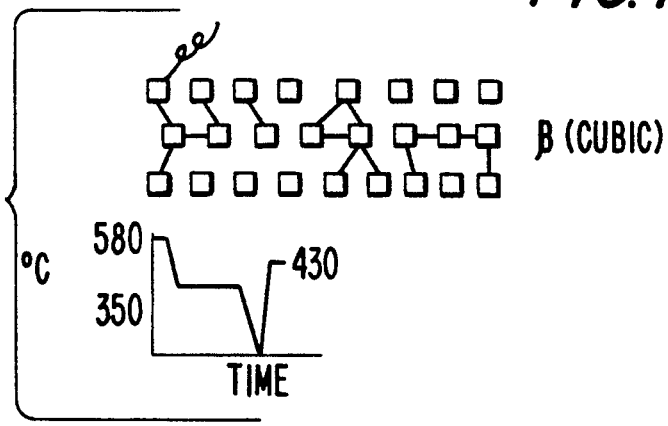

Although this invention is concerned with results rather than mechanisms, there follows a discussion of what we currently believe to be happening during cooling after homogenisation. Reference is directed to FIG. 1. When an ingot which has been homogenised for several hours at around 580° C. is rapidly cooled to about 350° C., the formation of beta-phase $Mg_2Si$ is suppressed, precipitation taking place wholly as the beta'-phase. This is a metastable hexagonal phase which grows as a lath with an irregular cross section; this irregularity is a consequence of the hold temperature. After 0.25 to 3 hours of holding, the $Mg_2Si$ is almost fully precipitated as uniform lath-shaped particles 1 to 5 (generally 3 to 4) microns long with a particles cross-section of up to 0.5 (generally 0.1 to 0.3) microns and a particle density of 7 to $16.10^4/mm^2$ (generally 8 to $13.10^4/mm^2$). The particle size and density figures are obtained by simple observation on a section through the ingot). This beta'-phase is semi-coherent with the aluminium matrix, and the resulting mismatch is accommodated by interfacial dislocation networks which entwine the phase. The principal features of the precipitate are shown schematically in FIGS. 1(*a*).

On reheating in the range 425°–450° C. for extrusion, rapid dissolution of the precipitate begins at temperatures at or greater than 380° C. The dissolution process is complex due to the irregular cross-section of the precipitate. Dissolution is most rapid at the points where the particles neck down close to the edge as shown schematically in FIG. 1(*b*). The result of this mechanism is the isolation of rows of beta'-phase debris which delineate the original edges of the beta'-phase laths prior to dissolution. Dissolution of the central spine of the beta'-phase continues until it reaches a finite size stabilized also by dislocations. This stage is schematically represented in FIG. 1(*c*). At this point of the beta'-phase dissolution sequence, cubic beta-phase $Mg_2Si$ heterogeneously nucleates on the beta'-phase debris. Each residual portion of beta'-phase $Mg_2Si$ becomes a nucleation site for beta-phase $Mg_2Si$ creating a high density of small particles of this phase as shown schematically in FIG. 1(*d*). These small particles are typically of sub-micron size (e.g. about 0.1 micron long), in comparison with the 5 to 10 micron particles formed when beta-phase $Mg_2Si$ is directly nucleated from solid solution at temperatures around 430°.

A similar restriction on beta-phase particle growth is seen during a hold period in the reheat temperature range prior to extrusion. Thus the interrupted cooling effected according to the present invention gives rise to not only a complete precipitation of supersaturated $Mg_2Si$ in fine uniform distribution throughout the matrix, but also to one which is not subject to particle coarsening during the reheat before extrusion. The fine particles are then readily and rapidly soluble during extrusion, giving an extrudate which can be subsequently be age-hardened to achieve desired UTS values in the region of 230 to 240 MPa.

The interrupted cooling treatment of the present invention is intermediate between different treatments used previously. For example, after, homogenisation of 6063 alloy for extrusion, it has been conventional to air-cool the ingot. This cooling schedule results in the precipitation and rapid coarsening of beta-phase $Mg_2Si$ temperatures around 430° C. These coarse particles are not re-dissolved during reheat and extrusion, with the result that the extrudate does not respond properly to age-hardening treatments, so that more Mg and Si are required to achieve a given UTS.

by contrast, in the method described in U.S. Pat. No. 3,222,227, the homogenised ingot is cooled fast enough to assure retention in solution of a large proportion of the Mg and Si, preferably most of it, and to assure that any precipitate that is formed is mainly present in the form of small particles i.e. under about 0.3 microns diameter. However, as a result of this rapid cooling treatment, the ingot is unnecessarily hard, with the result that attainable extrusion speeds are lower and extrusion temperatures higher than desired. Also, preheating of the ingot prior to extrusion would have to be carefully controlled to avoid the risk of precipitation of a coarse beta-phase $Mg_2Si$ at that time.

The invention has a number of advantages over the prior art, including the following:

1. The homogenised extrusion ingot has a yield stress approaching the minimum possible for the alloy composition. This results from the state of the $Mg_2Si$ precipitate. As a result, less work needs to be done to extrude the ingot.

2. The rate of heating the ingot prior to extrusion, and the holding time of the hot ingot prior to extrusion, are less critical than has previously been the case. Ingots according to this invention can be held for up to thirty minutes, or even up to sixty minutes, at elevated temperature without losing their improved extrusion characteristics. Again, this results from the state of the $Mg_2Si$ precipitate in the ingot.

3. During deformation and extrusion, the metal briefly reaches elevated temperatures of the order of 550° C. to 600° C. During this time, the $Mg_2Si$ particles are, as a result of their small size, substantially completely taken back into solution in the matrix metal.

4. As a result of 3, the quenched extrudate can readily be age-hardened. For a 6063 type alloy produced according to the invention, typical UTS values are in the range 230 to 240 MPa.

5. Because of the efficiency with which Mg and Si are used to achieve required hardness values when desired, the concentrations of these elements in the extrusion alloy can be lower than has previously been regarded as necessary to achieve the desired extrudate properties.

6. As a result of 1, a higher extrusion speed for a given emergent temperature can be obtained with increased productivity. It is known that the maximum exit temperature is one of the principal constraints limiting extrusion speed, since this can reach the region of the alloy solidus leading to liquation tearing at the die exit.

7. As a result of 5, the solidus of the extrusion alloy produced according to the invention can be higher than that of a corresponding alloy produced to existing conventional specifications, and this permits higher extrusion temperatures and hence further increased productivity.

The following examples illustrate the invention. Examples 1 to 5 refer to 6036-type alloys, Example 6 to 6082 and Example 7 to 6061.

EXAMPLE 1

Control of Chemical Composition

Figure 2:
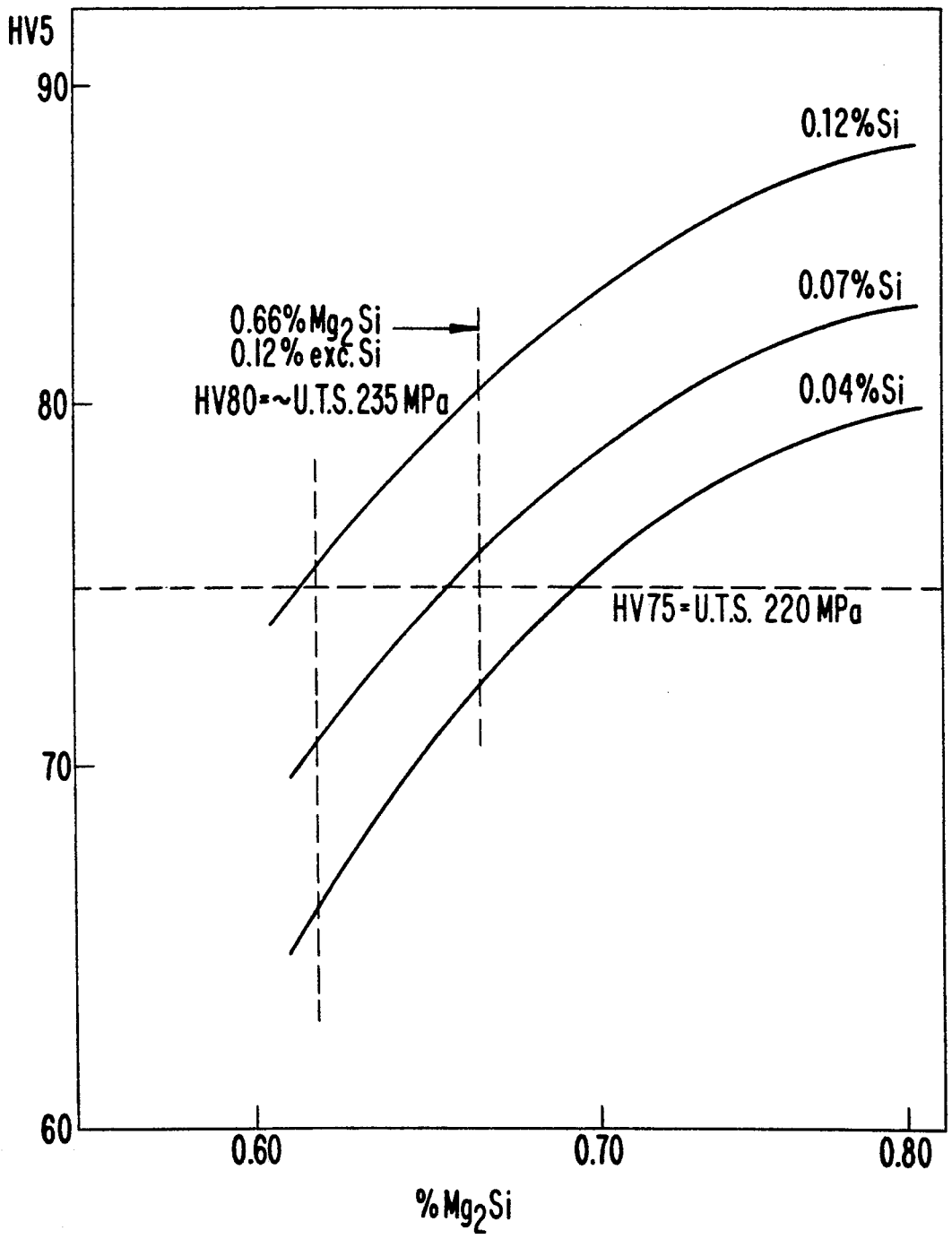
FIG. 2 is a graph showing the effect of $Mg_2Si$ and excess Si on maximum hardness obtainable.

Alloys were cast in the form of D.C. Ingot 178 mm in diameter with magnesium contents between 0.35 and 0.55 weight percent, silicon between 0.37 and 0.50 weight percent, iron 0.16 to 0.20 weight percent, and manganese either nil or 0.07%. Specimens from the ingots were homogenised for two hours at 585° C., water-quenched and aged for 24 hours at room temperature followed by five hours at 185° C. Hardness tests were then carried out and the results plotted as curves of hardness against $Mg_2Si$ content of the test materials at different excess silicon levels, the values of $Mg_2Si$ and excess Si being calculated in weight percent from the alloy compositions. The curves are shown in FIG. 2. This Figure is a graph of hardness (measured on the Vickers scale as HV5) against $Mg_2Si$ content of the alloy, and shows the effect of $Mg_2Si$ plus excess Si on the maximum hardness obtainable from 6063-type alloy. The curves indicate that a $Mg_2Si$ content of approximately 0.66%, with excess Si of 0.12%, can achieve the target mechanical properties of 78 to 82 HV5 (UTS of 230 to 240 MPa).

EXAMPLE 2

Figure 3:
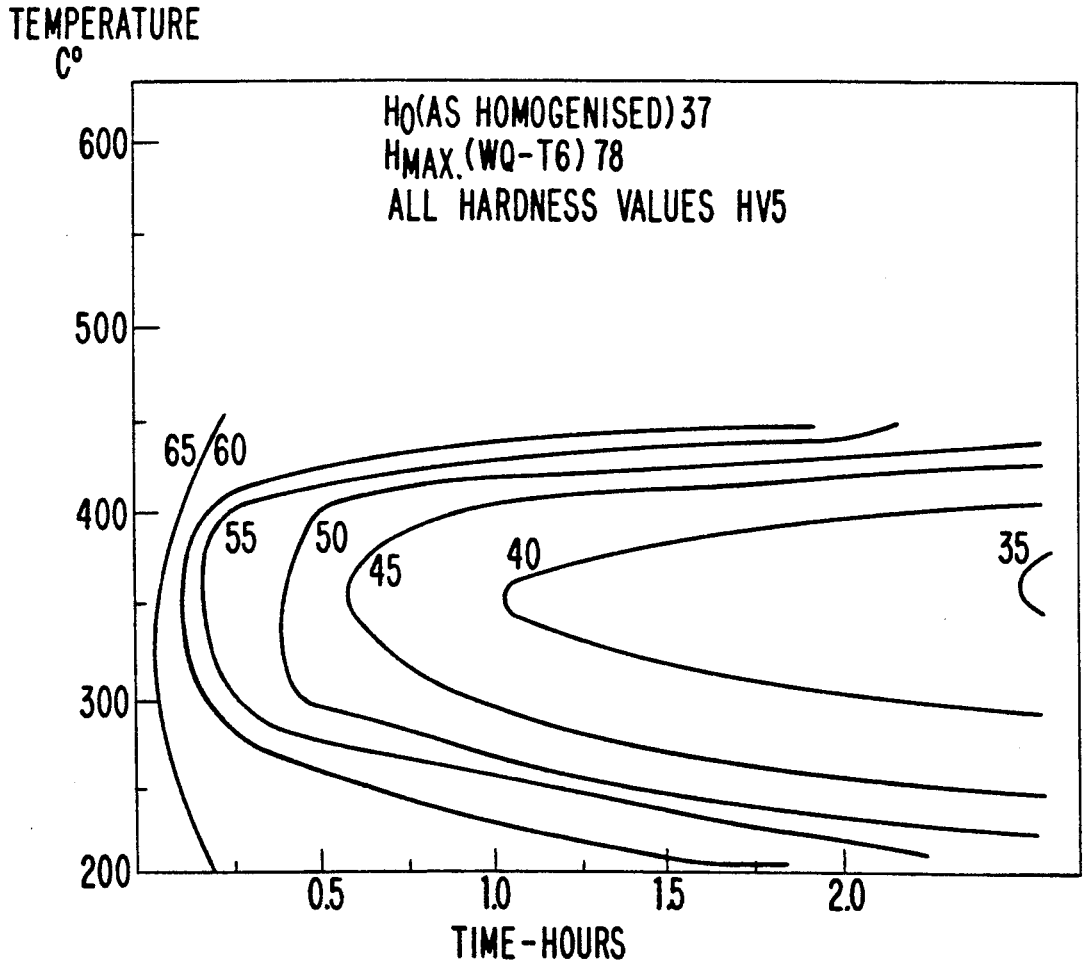
FIG. 3 is a time-temperature-transformation (TTT) curve during interrupted cooling after homogenisation.

Control of Cooling after homogenisation to produce a uniformly heterogenised microstructure In order to determine the optimum cooling route to produce full precipitation of the dissolved magnesium in the fine, uniform distribution required, time-temperature-transformation (TTT) curves were determined for alloys in the composition range under test. For this purpose, further discs were cut from alloys at the upper and lower end of the Mg and Si range and then further sectioned into pieces of approximately 5 mm cube, homogenised 2 h at 585° C. and cooled at controlled rates between 400 and 1000 deg.C/h to intermediate temperatures at 25 deg. C intervals between 450° and 200° C., cooling thence to room temperature at rates of approximately 8000 (water-quench) and 100 deg.C/h. After the completion of cooling each specimen was aged for 24 h at room temperature and then 5 h at 185° C. The specimens were then subjected to hardness testing and the values plotted on the axes of holding temperature and holding time to TTT curves. A typical example of a curve obtained is given in FIG. 3, for an alloy of composition Mg 0.44%, Si 0.36%, Mn 0.07%, Fe 0.17%, balance Al.

The general form of the curves is the same for both upper and lower ends of magnesium and silicon range tested, showing that full precipitation of solute occurs most rapidly in the temperature range between 350° and 300° C., progressively more slowly above 350° C. and very slowly above 425° C. and below 250° C. Holding between 350° C. and 300° C. give virtually complete precipitation of $Mg_2Si$ in about 1.5 h for initial cooling rates down to 1000 deg.C/h, and about 1 h for lower initial cooling rate. The temperatures range for range precipitation tends to become widened slightly if manganese between 0.03 and 0.10 percent is present.

EXAMPLE 3

Figure 4A:
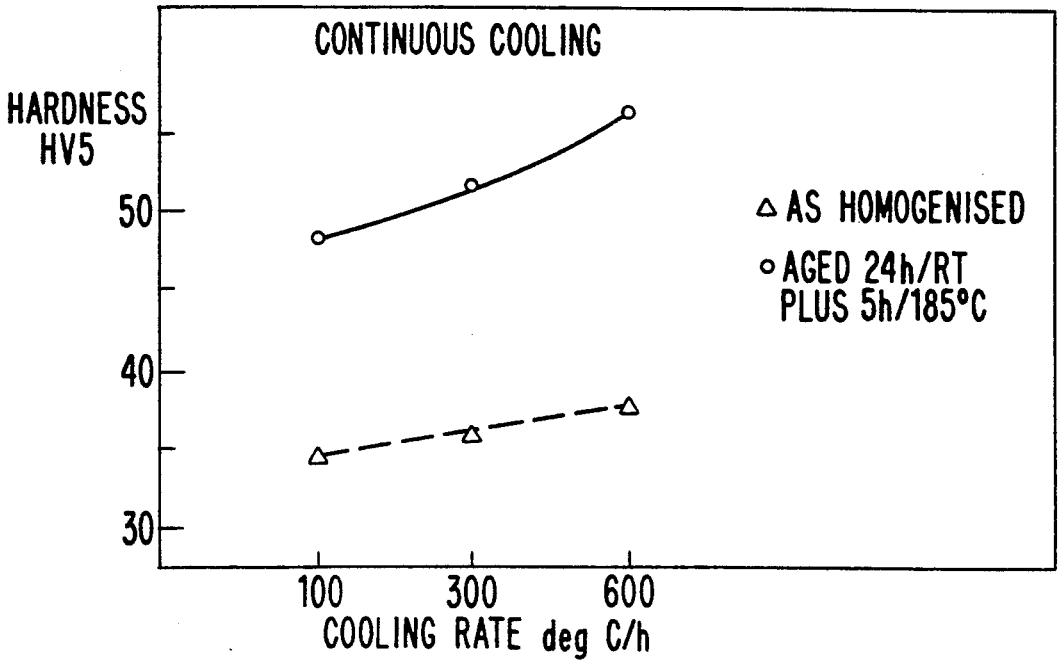
FIG. 4 is a two-part graph characterising the amount of $Mg_2Si$ precipitated on continuous, and on interrupted, cooling from homogenisation.
Figure 4B:
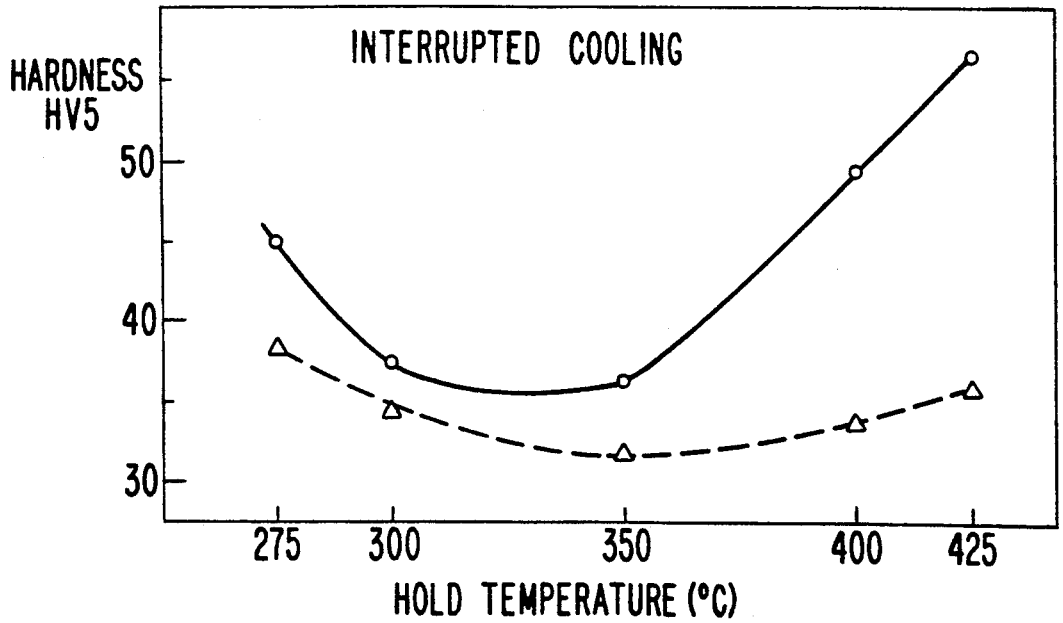

Further samples of the alloy used in Example 2 were homogenised and then cooled under various conditions. Some of the samples were then aged for 24 hours at room temperature and for 5 hours 185° C. The hardness of the samples, both as homogenised and after ageing, was measured. FIG. 4 is a two-part graph showing hardness on the HV5 scale against cooling conditions.

In FIG. 4(*a*) the samples were continuously cooled from the homogenising temperature to ambient at the rates shown. It can be seen that the ageing treatment produced a marked increase in hardness, from around 35 HV5 to around 50 HV5. This indicates that a substantial amount of $Mg_2Si$ were precipitated during age-hardening, i.e. that the homogenised cooled ingots contained a substantial proportion of Mg and Si in supersaturated solution.

FIG. 4(*b*) is a graph of hardness against hold temperature; all samples were initially cooled from homogenising temperature at a rate of 600° C./h. held at the hold temperature for 1 hour and then cooled to ambient temperature at 300° C./h. The solid curve representing the hardness of the aged samples shows a pronounced minimum to 300° to 350° C. hold temperature, where indeed it lies not far above the dotted line representing hardness of unaged samples. This indicates that, after holding at these temperatures, very little $Mg_2Si$ was precipitated on age-hardening, i.e. that substantially all the $Mg_2Si$ had been precipitated during the interrupted cooling sequence.

EXAMPLE 4

Behaviour of the interrupted-cool precipitate on subsequent heat-treatment simulation of the reheating and extrusion thermal cycle Measurements of temperatures reached by 6063 ingot during a typical preheating and extrusion cycle, using a rapid gas-fired conveyor furnace and extrusion speeds of 50–100 meters/minute, have shown that an ingot can spend around ten minutes at a temperature of 350° or above in the preheat furnace and subsequently reach maxima of 550° to 660° C. in the deformation zone during extrusion, for very short times, for example 0.2 to 1 second. To carry out a laboratory heat-treatment simulation of the cycle the following procedure was adopted.

Specimens approximately 10 mm cube were cut from 178 mm diameter ingots having compositions between 0.41 to 0.45 weight percent each of magnesium and silicon, 0.16 and 0.20 weight percent iron, 0.03 to 0.07 percent manganese and 0.015 to 0.025 percent titanium (as A1-5Ti-1B grain refiner) homogenised for 2 h at 585°–590° and cooled at 600 deg.C/h to 350° C., held at this temperature for 1 h then cooled at 300 deg.C/h to room temperature.

The following heat treatments were then carried out:

(a) Age from the as-homogenised condition 24 h at room temperature then 5 h/185° C.

(b) heat 0.5 h/350° C., water quench, age 24 h at room temperature then 5 h/185° C.

(c) Heat 0.5 h/350° C., raise quickly to 550° C. for 1 second, water quench, age 24 h at room temperature then 5 h/185° C.

(d) As (c) but using final heat treatment temperature of 575° C.

(e) As (c) but using final heat treatment temperature of 600° C.

Figure 5:
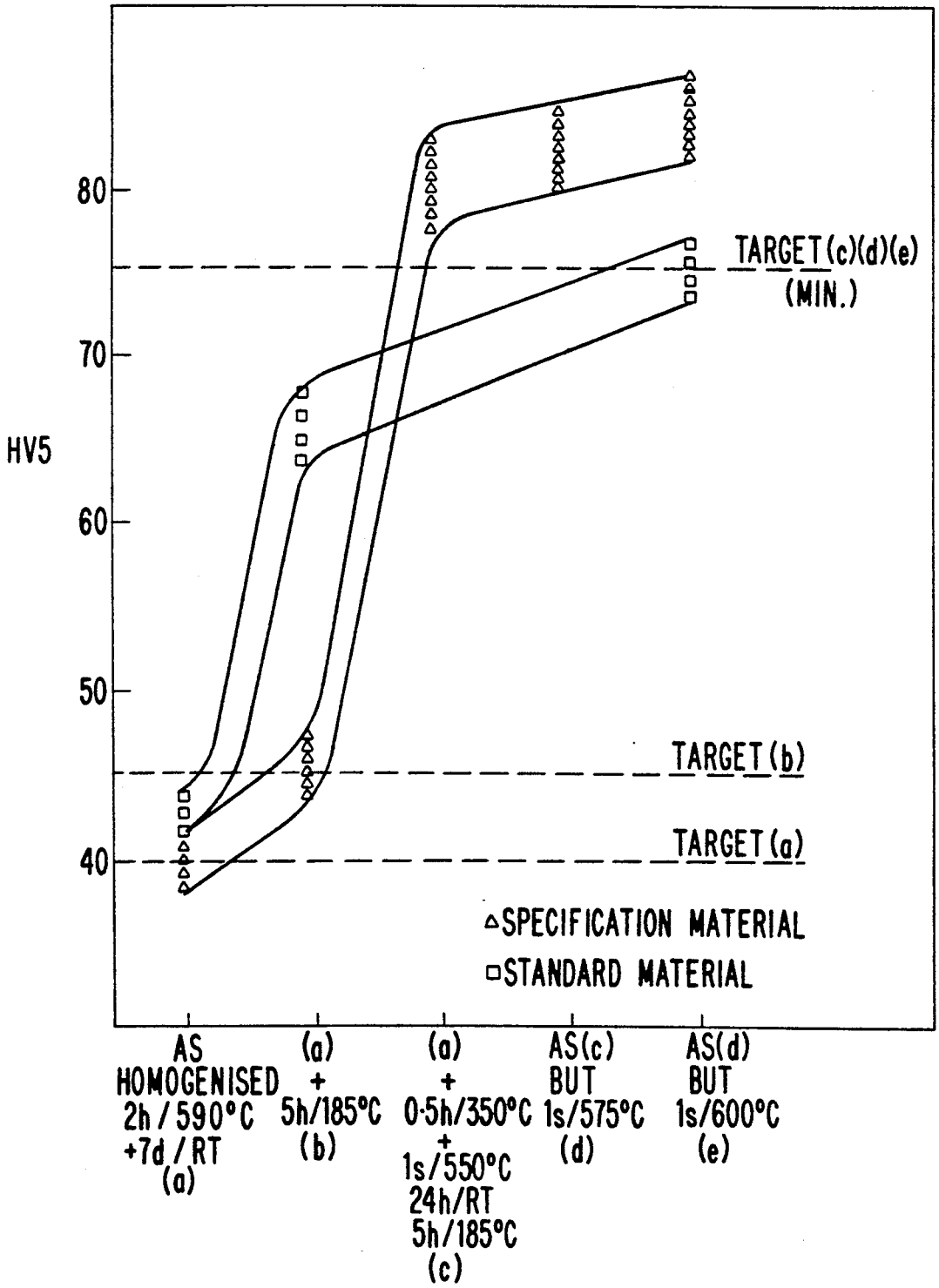
FIG. 5 is a diagram showing the response of two different alloys to various different heat treatments.

Hardness tests were carried out on all specimens after ageing and results are shown diagramatically in FIG. 5. For comparison, specimens from ingot of the same composition but homogenised with continuous cooling at 200 and 600 deg.C/h were similarly treated. Hardness tests results on this material are also given in FIG. 5.

These results confirm that the magnesium silicide precipitation is virtually complete in the material homgenised with interrupted cool, remains stable after a simulated reheat, then re-dissolves almost completely after a very short solution treatment at temperatures likely to be reached in the extrusion deformation zone. On the other hand, material homogenised with the continuous cooling treatments exhibits less complete magnesium silicide precipitation and dissolves less completely on similar short solution treatments suggesting a less consistent behaviour in the simulated extrusion thermal cycle.

EXAMPLE 5

Extrusion performance of specification ingot Homogenised with interrupted cool In order to test the extrusion performance of ingot manufactured according the invention, a trail was carried using a commercial extrusion press. Ingot prepared in accordance with all the features of the invention including interrupted cooling after homogenisation was extruded together with a control ingot produced to normal 6063 alloy composition limits, casting and homogenisation procedures. Exit temperatures and speeds of the extruded sections produced from each of the trail ingots, and tensile properties and anodising behaviour of the extruded sections after ageing to the T5 condition were determined. Extrusion exit temperatures and speeds are shown graphically in FIG. 6. Tensile properties and surface quality assessments are set out in Table 1 below, which also gives the chemical compositions of the ingots extruded.

TABLE 1

| | Fe | Mg | Mn | Si |
|---|---|---|---|---|
| Control Ingot | 0.20 | 0.49 | 0.07 | 0.44 |
| Specification Ingot | 0.18 | 0.42 | 0.05 | 0.45 |

Surface Assessments—Extruded Product

Both control and specification material satisfactory, free from defects and normal for the die extruded.

Anodised Extrusions

Both control and specification material satisfactory uniform finish free from defects.

| | Tensile Properties (aged to T5 temper) | | |
|---|---|---|---|
| | 0.2% proof stress MPa | U.T.S. MPa | Elongation % on 50 mm |
| Control Material | 208.6 | 241.6 | 11 |
| | 223.0 | 254.0 | 12 |
| Specification Material | 207.1 | 233.0 | 10½ |
| | 208.0 | 237.0 | 11 |

Figure 6:
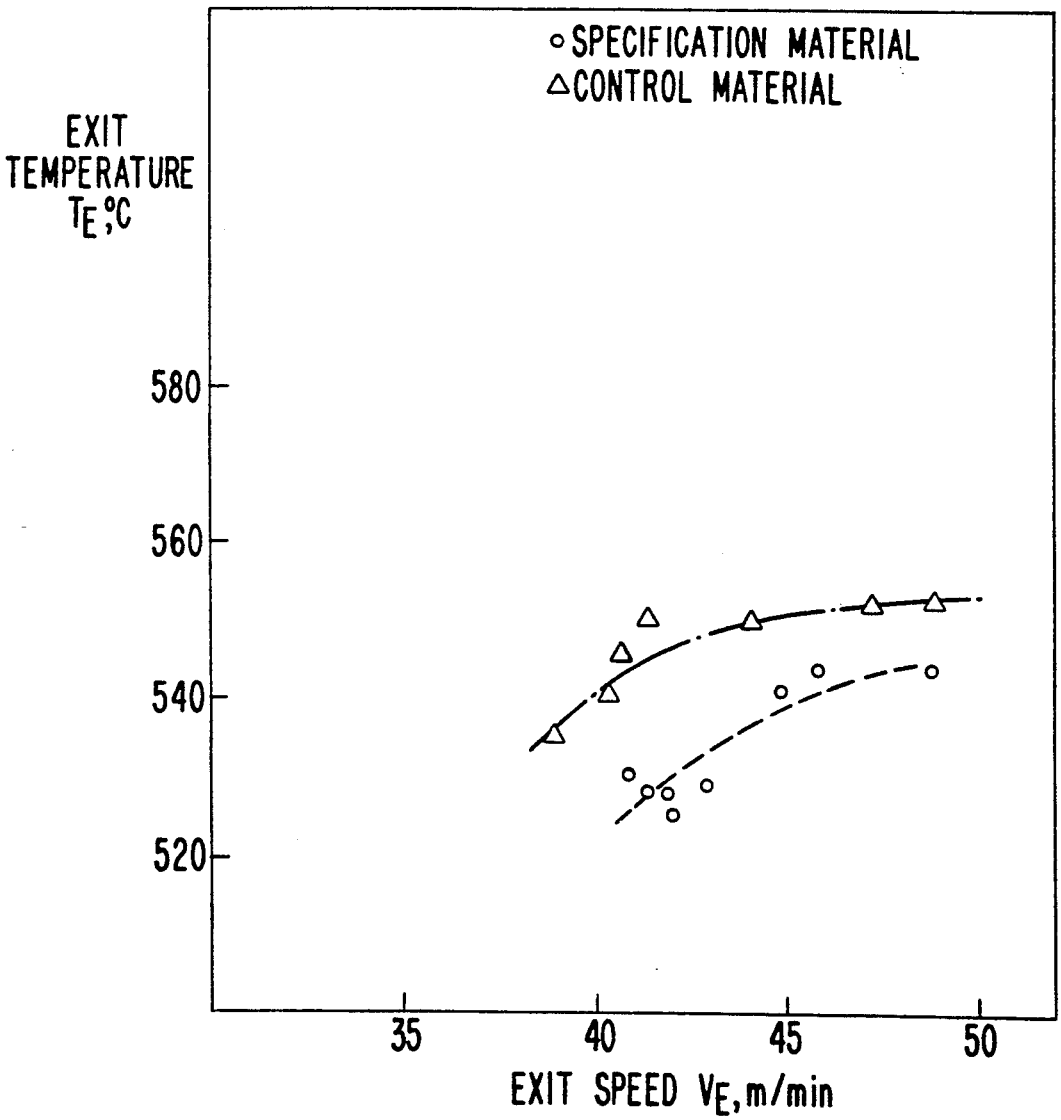
FIG. 6 is a graph showing extrusion speed against exit temperature for two different alloys.

FIG. 6 shows that for the full specification material, the exit temperature for a given exit speed was some 10°-20° C. lower (depending on speed) than for the control material. The tensile properties were lower for the specification than for the control, although well in excess of the European 6063-F22 requirements (minimum U.T.S. 215 MPa) and well up to the target of 230-240 MPa. The surface finish quality of the extruded products, both before and after anodising, was fully satisfactory for both specification and control materials.

The temperature/speed relationship obtained show that the full specification ingot has the capability to achieve higher, speeds for a given exit temperature than the control material and at the same time gives an extruded product of fully acceptable mechanical properties and surface quality.

EXAMPLE 6

Experiments following the pattern of Examples 1 to 4 indicated that within the limits of the 6082 chemical specification it is possible to achieve a typical UTS of 330 MPa to T6 extrusions within the composition limits given above.

It was found possible to produce this composition as 178 mm dia. ingot with a suitable thin-shell D.C. casting practice and grain refinement with 0.02% Ti, added as $TiB_2$ with a uniform cell size of 33-38 microns, a uniform grain size of 50-70 microns, and a surface segregation depth of less than 50 microns. Full homogenisation of solute elements is achieved with a soak time of two hours at 550°-570° C. Step-cooling from homogenisation temperature for one hour at 400° C., 15 minutes at 320° C. or 30 minutes at 275° C. (in each case cooling to the step temperature at 800 deg.C/h) gives full precipitation of supersaturated $Mg_2Si$ as beta' in a fine, uniform distribution. However, a very small amount of beta-phase precipitate was also observed at all hold temperatures; this was formed during cooling to the hold temperature. Hot torsion tests show approximately 5% reduction in flow stress for such treatments in comparison with conventional cooling. This would be expected to give approximately 24% increase in extrusion speed for a given pressure.

An extrusion trial was carried out to compare the performance of ingot of the specification composition and cast structure homogenised with step-cooling and with conventional continuous cooling. The following results were obtained:

Ingot composition: Mg 0.68, Si 0.87, Mn 0.48, Fe 0.20 (weight percent)
Ingot diameter: 178 mm
Homogenisation: Soak time 3 h at 575° C.
Cooling: Conventional: approximately 400 deg.C/h (average to below 100° C.
Step:
approximately 600 deg. C/h (average) to hold temperature (approx. 320°-350° C.)
Hold approx. 30 min then rapid cool to below 100° C.
(a) Extrusion temperature: 470°-510° C.
Extruded shape: 25 mm diameter bar
Extrusion pressure (max):
Conventionally homogenised ingot 153-155 kp/cm$^2$
Step cooled ingot 144-148 kp/cm$^2$
Extrusion exit speed:
Conventionally homogenised ingot: 20 meters/minute
Step-cooled ingot: 25-30 meters/minute
Water quench at press—quench rate>1500 deg.C/min
Mechanical properties of extrudate (aged to T6 temper., 10 h/170°)
Conventionally homogenised:
0.2% proof stress: 343.8-344.1 Mpa
Ultimate tensile strength: 363.9-364.0 MPa
Elongation on 50 mm: 16.3%
Reduction of area at fracture: 56.58%
Step cooled
0.2% proof stress 335.9-336.1 MPa
Ultimate tensile strength: 355.6-356.2 MPa
Elongation on 50 mm: 14.7-15.2%
Reduction of area at fractures: 55-56%
(b) Extrusion temperature: 480°-515° C.
Extruded shape: 50×10 mm flat bar
Extrusion pressure (max):
Conventionally homogenised ingot: 140 kp/cm$^2$
Step cooled ingot: 135 kp/cm$^2$
Extrusion exit speed:
Conventionally homogenised ingot: 40 meters/minute
Step-cooled ingot: 42-45 meters/minute
Water quench at press—quench rate <1500 deg.C/min
Mechanical properties of extrudate (aged to T6 temper. 10 h/170°C.)
Conventionally homogenised:
0.2% proof stress, 307/5-311.0 MPa
Ultimate tensile strength, 324.3-327.9 MPa
Elongation on 50 mm: 15.4-16.3%
Reduction of area at fracture: 63-65%
Step-cooled:
0.2% proof stress, 302.7-302.9 MPa
Ultimate tensile strength, 326.4-327.1 MPa
Elongation on 50 mm: 15.6-16.4%

Reduction of area at fracture: 61–62%

EXAMPLE 7

Experiments similar in scope to those of Example 6 indicated that it was possible to achieve a reduction in flow stress of about 3%, with satisfactory T6 temper extruded mechanical properties, in 6061 ingot homogenised with a suitable step-cool treatment, the alloy having the composition limits given above. Following homogenising for up to four hours at 550°–570° C., the step-cool treatment in this case was accomplished by cooling at 600° C./hour to 400° C. holding 30 minutes at 400° C. then rapid cooling to below 100° C.

An extrusion trail was carried out to compare the performance of conventionally homogenised ingot with that of step-cooled ingot of this composition. The following results were obtained:

Ingot composition (weight percent): Cu 0.34, Fe 0.19, Mg 1.04, Mn 0.09, Si 0.65, Cr 0.18, Ti 0.027
Ingot diameter: 75 mm
Homogenisation: Soak time 1 hour at 570° C.
Cooling:
  Conventional: 600° C./hour to below 100° C.
  Step-cooling: 600° C./hour to 400° C., hold 30 minutes then rapid cool to below 100° C.
Exit speed: 21.8 meters/minute
Extrusion temperature: 520° C.
Extruded shape: 5×32 mm flat bar
Induction preheat (2 minutes to temperature), max extrusion pressure at ram/billet interface;
  Conventionally homogenised ingot: 373 MPa
  Step cooled ingot: 363 MPa
Gas preheat (15 minutes to temperature), max extrusion pressure at ram/billet interface:
  Conventionally homogenised ingot: 349 MPa
  Step-cooled ingot: 343 MPa
Mechanical properties of extrudate after press water quench (cooling rate >1500° C./minute), then ageing 24 hours at room temperature plus 7 hours at 175° C. (T6 temper):
  Induction preheat:
    Conventionally homogenised ingot: 0.2% proof stress 290.9 MPa
    Ultimate tensile strength: 324.1 MPa
    Elongation: 12.0% on 50 mm
  Step-cooled ingot: 0.2% proof stress 280.9 MPa
  Ultimate tensile strength: 314.8 MPa
  Elongation: 11.6% on 50 mm
Gas preheat:
  Conventionally homogenised ingot: 0.2% proof stress 296.7 MPa
    Ultimate tensile strength: 325.4 MPa
    Elongation: 10.5% on 50 mm
  Step-cooled ingot: 0.2% proof stress 295.7 MPa
    Ultimate tensile strength: 324.3 MPa
    Elongation: 11.0% on 50 mm

We claim:

1. An aluminium-based extrusion ingot of an Al-Mg-Si alloy wherein substantially all the Mg is present in the form of particles having an average diameter of at least 0.1 microns of beta'-phase $Mg_2Si$ in the substantial absence of beta-phase $Mg_2Si$, and wherein any iron present is in the form of alpha-Al-Fe-Si particles below 15 microns long and with 90% below six microns long.

2. An extrusion ingot as claimed in claim 1, consisting essentially of:

| | |
|---|---|
| Mg | 0.39 to 1.50% |
| Si | 0.35 to 1.30% |
| Fe | 0 to 0.24% |
| Mn | 0 to 0.10% |
| Ti | 0 to 0.05% |

Al balance apart from incidental impurities up to a maximum of 0.05% each 0.15% total.

3. An extrusion ingot as claimed in claim 2, consisting essentially of:

| | |
|---|---|
| Mg | 0.42 to 0.46% |
| Si | 0.42 to 0.46% |
| Fe | 0.16 to 0.20% |
| Mn | 0.03 to 0.07% |
| Ti | 0.015 to 0.025% |

Al balance apart from incidental impurities up to a maximum of 0.05% each 0.15% total.

4. An extrusion ingot as claimed in claim 1, consisting essentially of:

| | |
|---|---|
| Mg | 0.50–0.70% |
| Si | 0.85–0.95% |
| Mn | 0.40–0.50% |
| Fe | 0.18–0.30% |
| Ti | 0.01–0.03% |

balance Al apart from incidental impurities and minor alloying elements, each maximum 0.05% total 0.15%.

5. An extrusion ingot as claimed in claim 1, consisting essentially of:

| | |
|---|---|
| Mg | 0.70–1.10% |
| Si | 0.60–0.70% |
| Mn | 0–0.15% |
| Fe | 0.18–0.25% |
| Ti | 0.01–0.03% |
| Cu | 0.01–0.40% |
| Cr | 0.12–0.20% |

balance Al apart from incidental impurities and minor alloying elements, each maximum 0.05% total 0.15%.

6. An extrusion ingot as claimed in claim 1, said ingot having a uniform grain size of 70 to 90 μ.

7. An extrusion ingot as claimed in claim 1, said ingot having a cell size in the range from 28 to 35 microns over the whole ingot cross-section.

8. An extrusion ingot as claimed in claim 1, wherein the Al-Mg-Si alloy contains at least 0.16% Fe.

* * * * *